US010314331B2

(12) United States Patent
Poget et al.

(10) Patent No.: US 10,314,331 B2
(45) **Date of Patent: *Jun. 11, 2019**

(54) SMOKING ARTICLE WITH HEAT RESISTANT SHEET MATERIAL

(71) Applicant: Philip Morris USA Inc., Richmond, VA (US)

(72) Inventors: Laurent Poget, Bussigny (CH); Alexandre Malgat, Rouffach (FR); Christoph Sorg, Munich (DE); Andreas Hofenauer, Eichenau (DE); David Croll, Poing (DE); Rolf Gericke, Holzkirchen (DE)

(73) Assignee: Philip Morris USA Inc., Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/461,947

(22) Filed: Mar. 17, 2017

(65) Prior Publication Data

US 2017/0181469 A1 Jun. 29, 2017

Related U.S. Application Data

(63) Continuation of application No. 14/556,995, filed on Dec. 1, 2014, now Pat. No. 9,730,468, which is a (Continued)

(30) Foreign Application Priority Data

Mar. 26, 2010 (EP) ..... 10250601

(51) Int. Cl.

| | |
|---|---|
| ***A24D 1/02*** | (2006.01) |
| ***A24F 47/00*** | (2006.01) |
| ***A24B 15/16*** | (2006.01) |

(52) U.S. Cl.
CPC ..... *A24D 1/02* (2013.01); *A24B 15/165* (2013.01); *A24F 47/006* (2013.01); *A24F 47/008* (2013.01)

(58) Field of Classification Search
None
See application file for complete search history.

(56) References Cited

U.S. PATENT DOCUMENTS

| | | | |
|---|---|---|---|
| 3,429,827 | A | 2/1969 | Ruus |
| 4,714,082 | A | 12/1987 | Banerjee et al. |

(Continued)

FOREIGN PATENT DOCUMENTS

| | | |
|---|---|---|
| EA | 0174645 | 3/1986 |
| EP | 2316286 A1 | 5/2011 |

(Continued)

OTHER PUBLICATIONS

"Filler Minerals Reference, A Guide to Filler Properties and Uses," Information Sheet [online] R.T. Vanderbilt Company, Inc. 2009 [retrieved on Jan. 20, 2011], Retrieved from the Internet: <URL: http://www.rtvanderbilt.com/VR703forweb.pdf>. (Year: 2009).*

(Continued)

*Primary Examiner* — Dennis R Cordray
(74) *Attorney, Agent, or Firm* — Harness, Dickey & Pierce, P.L.C.

(57) ABSTRACT

A smoking article includes a sheet material including a fibrous layer formed of cellulosic fibers and at least 50% by weight of inorganic filler material having a particle size in range of from 0.1 microns and 50 microns, wherein the sheet material has a tensile strength of at least 900 N/m. The fibrous layer includes a binder material, such as an organic binder material. The organic binder material can be a cellulosic binder material. A coating layer may be provided on at least one side of the fibrous layer.

22 Claims, 1 Drawing Sheet

Related U.S. Application Data continuation of application No. 13/637,263, filed as application No. PCT/IB2011/001147 on Mar. 28, 2011, now Pat. No. 8,915,255.

(56) References Cited

U.S. PATENT DOCUMENTS

| | | | |
|---|---|---|---|
| 4,756,318 | A | 7/1988 | Clearman et al. |
| 4,891,172 | A | 1/1990 | Matsushita et al. |
| 5,040,552 | A | 8/1991 | Schleich et al. |
| 5,060,676 | A | 10/1991 | Heam et al. |
| 5,095,921 | A | 3/1992 | Losee et al. |
| 5,146,934 | A | 9/1992 | Deevi et al. |
| 5,188,130 | A | 2/1993 | Hajaligol et al. |
| 5,240,014 | A | 8/1993 | Deevi et al. |
| 5,246,018 | A | 9/1993 | Deevi et al. |
| 5,247,949 | A | 9/1993 | Deevi et al. |
| 5,248,375 | A | 9/1993 | Steiniger |
| 5,303,720 | A | 4/1994 | Banerjee et al. |
| 5,443,560 | A | 8/1995 | Deevi et al. |
| 5,468,266 | A | 11/1995 | Bensalem et al. |
| 5,595,577 | A | 1/1997 | Bensalem et al. |
| 5,928,741 | A | 7/1999 | Andersen et al. |
| 5,947,126 | A | 9/1999 | Wilson et al. |
| 6,095,152 | A | 8/2000 | Beven et al. |
| 6,904,918 | B2 | 6/2005 | Snaidr et al. |
| 2004/0025894 | A1 | 2/2004 | Beven et al. |
| 2005/0000530 | A1 | 1/2005 | Snaidr et al. |
| 2005/0016556 | A1 | 1/2005 | Ashcraft et al. |
| 2006/0144412 | A1 | 7/2006 | Mishra et al. |
| 2011/0126848 | A1 | 6/2011 | Zuber et al. |
| 2013/0146075 | A1 | 6/2013 | Poget et al. |

FOREIGN PATENT DOCUMENTS

| | | | |
|---|---|---|---|
| GB | 1537512 | | 12/1978 |
| JP | S6460363 | A | 3/1989 |
| JP | 10-507629 | | 7/1998 |
| JP | 2009050280 | | 3/2009 |
| WO | WO-8303061 | A1 | 9/1983 |
| WO | WO-96/07336 | | 3/1996 |
| WO | WO-03/020056 | | 3/2003 |
| WO | WO-03077687 | A2 | 9/2003 |
| WO | WO-2004041251 | A1 | 5/2004 |
| WO | WO-2006082529 | A2 | 8/2006 |
| WO | WO-2009/015142 | A2 | 1/2009 |
| WO | WO-2009/022232 | A2 | 2/2009 |
| WO | WO-2009094859 | A1 | 8/2009 |
| WO | WO-2011050964 | A1 | 5/2011 |
| WO | WO-2011117747 | A2 | 9/2011 |
| WO | WO-2011117750 | A2 | 9/2011 |

OTHER PUBLICATIONS

Office Action dated Apr. 11, 2014 in Australian Application No. 2011231251.
Office Action dated Jan. 25, 2017 in Canadian Application No. 2,794,337.
First Office Action and Search Report dated Sep. 24, 2014 in Chinese Application No. 201180016009.6.
Second Office Action dated Aug. 5, 2015 in Chinese Application No. 201180016009.6.
Tnird Office Action dated Mar. 18, 2016 in Chinese Application No. 201180016009.6.
Zhu Yongqiang, "The paper-making filler types and their properties", Shanghai Paper-making, Apr. 30, 2005, pp. 36 to 40, vol. 36, issue 2, in China.
Office Action dated Apr. 9, 2013 in Columbian Application No. 12-188631.
Office Action dated Sep. 30, 2015 in Eurasian Application No. 201290960.
Search Report dated Oct. 7, 2010 in European Application No. 10250601.1.
Office Action dated Sep. 15, 2016 in Indonesian Application No. W-00201204297.
Office Action dated Feb. 21, 2017 in Israel Application No. 221802.
Office Action dated Mar. 2, 2015 in Japanese Application No. JP 2013-500614.
Office Action dated Apr. 28, 2017 in Korean Application No. 10-2012-7027386.
Final Office Action dated Oct. 24, 2017 in Korean Application No. 10-2012-7027386.
First Office Action dated Jun. 4, 2014 in Mexicon Application No. MX/a/2012/011142.
Second Office Action dated Mar. 6, 2015 in Mexicon Application No. MX/a/2012/011142.
Office Action and search report dated Aug. 15, 2016 in Malaysian Application No. PI 2012004018.
First Office Action dated Feb. 8, 2013 in New Zealan Application No. 602319.
International Search Report and Written Opinion dated Sep. 30, 2011 in International Application No. PCT/IB2011/001147.
First Office Action dated Aug. 27, 2015 in Philippines Application No. 1-2012-501801.
Second Office Action dated Mar. 17, 2016 in Philippines Application No. 1-2012-501801.
Third Office Action dated Apr. 12, 2016 in Philippines Application No. 1-2012-501801.
Search Report and Written Opinion dated Dec. 11, 2014 in Singapore Application No. 201207140-3.
Second Written Opinion dated Feb. 7, 2017 in Singapore Application No. 201207140-3.
Office Action dated Jul. 27, 2015 in Vietnamese Application No. 1-2012-02934.
Korean Office Action for corresponding Application No. 10-2018-7016487 dated Jul. 16, 2018, English translation thereof.
Singaporean Office Action for corresponding Application No. 201207140-3 dated Mar. 21, 2018, English translation thereof.
Indian Office Action for corresponding Application No. 7847/DELNP/2012 dated Aug. 10, 2018, English translation thereof.
W. Qiongju, "Concise Manual of Convectional Papers", Chemical Industry Press, Jan. 2005, 1st edition, p. 216.
H. Kaitang, "The structure of Paper Sheets and Its Properties", China Light Industry Press, Jan. 2006 1st, edition, p. 53.
Japanese Office Action dated Jun. 15, 2015 for corresponding Application No. 2013-500604.
Korean Office Action for corresponding Application No. 10-2012-7027386 dated Mar. 11, 2018, English translation thereof.
International Standard ISO 1924/2-1985, "Paper and board—Determination of tensile properties—Part 2: Constant rate of elongation method."
Office Action dated Sep. 4, 2013 for Colombian Patent Application No. 12188631.
Brazilian Office Action for corresponding Application No. BR112012024370 dated Feb. 4. 2019, English translation thereof.
Korean Notice of Allowance for corresponding Application No. 10-2018-7016487 dated Feb. 27, 2019.
Japanese Notice of Allowance for corresponding Application No. 10-2018-7016487 dated Feb. 27, 2019, English translation thereof.

* cited by examiner

SMOKING ARTICLE WITH HEAT RESISTANT SHEET MATERIAL

CROSS-REFERENCE TO RELATED APPLICATIONS

This is a continuation of, and claims priority under 35 U.S.C. § 120 to, U.S. application Ser. No. 14/556,995, filed Dec. 1, 2014, which is a continuation of U.S. application Ser. No. 13/637,263, filed Feb. 7, 2013, and claims priority of International Application No. PCT/IB2011/001147, filed Mar. 28, 2011, which, in turn, claims priority to European Patent Application No. 10250601.1, filed Mar. 26, 2010. The entire contents of each of which are hereby incorporated herein by reference.

SUMMARY OF SELECTED FEATURES

The present invention relates to a smoking article with a heat resistant sheet material. In particular, the heat resistant sheet material may be provided as an outer wrapper for a non-combusted smoking article or as a tipping paper for any type of smoking article.

A number of smoking articles in which tobacco is heated rather than combusted have been proposed in the art. The aim of such heated smoking articles is to reduce known harmful smoke constituents produced by the combustion and pyrolytic degradation of tobacco in conventional cigarettes. In heated smoking articles, an aerosol is generated by heating a flavour generating substrate, such as tobacco. Known heated smoking articles include, for example, electrically heated smoking articles and smoking articles, in which an aerosol is generated by the transfer of heat from a combustible fuel element or heat source to a physically separate aerosol forming material. The aerosol forming material may be located within, around or downstream of the fuel element. During smoking, volatile compounds are released from the aerosol forming material by heat transfer from the fuel element and entrained in air drawn through the smoking article. As the released compounds cool they condense to form an aerosol that is inhaled by the consumer.

All patents and published patent applications referenced herein are hereby incorporated in their entirety by reference including without limitation WO-A-2009/022232, EP-A-09252687.0 corresponding to U.S. Patent Publication No. 2011/0126848 and EP-A-09252501.3 corresponding to WO 2011/050964.

For example, U.S. Pat. No. 4,714,082 discloses smoking articles comprising a high density combustible fuel element, a physically separate aerosol generating means and a heat-conducting member. The heat-conducting member contacts the fuel element and the aerosol generating means around at least a portion of their peripheral surfaces and conducts heat from the burning fuel element to the aerosol generating means. The heat-conducting member preferably is recessed from the lighting end of the fuel element.

U.S. Pat. No. 5,303,720 discloses smoking articles comprising a fuel element, a physically separate aerosol generating means and an insulating member circumscribing at least a portion of the fuel element. The insulating member is formed of a mixture of an inorganic fibrous material with a fibrillated cellulose-based fibre pulp.

U.S. Pat. No. 6,095,152 discloses smoking articles comprising a combustible fuel source and an aerosol generator, both extending along the length of a rod of smoking material. The smoking material rod is enwrapped in a non-combustible wrapper.

One particular category of heated smoking articles is the distillation-based smoking article. For example, WO-A-2009/022232 discloses a distillation-based smoking article comprising a combustible heat source, an aerosol-generating substrate downstream of the combustible heat source and a heat-conducting element around and in contact with a rear portion of the combustible heat source and an adjacent front portion of the aerosol-generating substrate.

In the majority of known heated smoking articles, the aerosol-generating substrate is circumscribed by an outer wrapper. In those heated smoking articles which comprise a combustible heat source, the outer wrapper may also extend such that it circumscribes at least part of the heat source. Typically, the outer wrapper is formed of conventional cigarette paper, of the type used to circumscribe the tobacco and filter in a conventional combustible cigarette.

During use of a heated smoking article, the heat source may reach high temperatures. For example, a heat source may reach an average temperature of around 500° C. and in certain cases, the temperature of the heat source may reach as high as 800° C. for a short period of time during the heating cycle.

It would be desirable to provide a smoking article comprising an improved sheet material. In particular, it would be desirable to provide a heated smoking article with an outer wrapper formed of an improved sheet material which is resistant to the heat generated by a combustible or non-combustible heat source, for example an electrical heat source, during use of the smoking article. Furthermore, it would be desirable to provide a smoking article including a sheet material that retains physical integrity and exhibits minimum discolouration when subjected to heat from the heat source used in a heated smoking article. It would be particularly desirable if such a material could have suitable properties to be applied to heated smoking articles using existing apparatus and methods.

It would also be desirable to provide a heated or combustible smoking article with a tipping paper formed of a sheet material having the properties described above.

BRIEF DESCRIPTION OF THE DRAWINGS

The invention will be further described, by way of example only, with reference to the accompanying figures in which.

DETAILED DESCRIPTION

Figure 1:
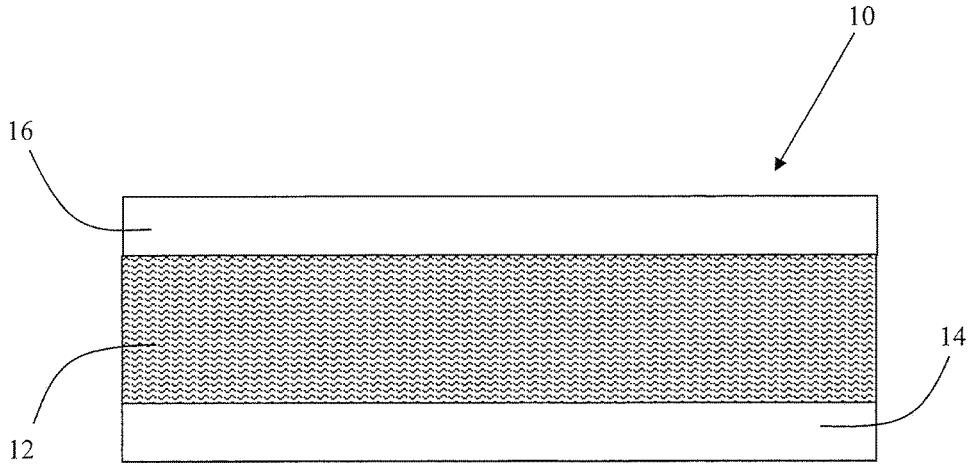
FIG. 1 shows a schematic, transverse cross-section of a heat resistant sheet material suitable for use in a smoking article according to the present invention.

In accordance with the invention there is provided a smoking article including a heat resistant sheet material, the sheet material comprising a fibrous layer formed of cellulosic fibres and at least 50 percent by weight of an inorganic filler material having a particle size in the range of from 0.1 microns to 50 microns, wherein the sheet material has a tensile strength of at least 900 N/m. Preferably, the sheet material according to the invention comprises a fibrous layer formed of cellulosic fibres and at least 60 percent by weight of inorganic filler material. Preferably, the sheet material according to the invention has a tensile strength of at least 1300 N/m.

The "tensile strength" of a sheet material is a measure of the force required to stretch the material until it breaks. More specifically, the tensile strength is the maximum tensile force per unit width that the sheet material will withstand before breaking and is measured in the machine direction of the sheet material. It is expressed in units of Newtons per meter of material (N/m). Tests for measuring the tensile strength of a sheet material are well known. A suitable test is described in International Standard ISO 1924/2 entitled "Paper and board—Determination of tensile properties—Part 2: Constant rate of elongation method".

The test utilises tensile testing apparatus which is designed to extend a test piece of given dimensions at an appropriate constant rate of elongation and to measure the tensile force and, if required, the elongation produced. Each test piece of sheet material is held in two clamps, the separation of which is adjusted at a specified rate. For example, for a 180 mm test length the rate is 20 mm per minute. The tensile force is measured as a function of elongation and the test is continued until the test piece ruptures. The maximum tensile force is measured, as well as the elongation at break. The tensile strength of the material may be calculated from the following equation in which S is the tensile strength in N/m, $\overline{F}$ is the mean tensile force in Newton and w is the width of the test piece in meters:

$$S = \frac{\overline{F}}{w}$$

For the heat resistant sheet material used in the smoking articles of the present invention, it is important that the tensile strength is such that the sheet material can be wound onto conventional paper bobbins and can withstand the stresses and strains to which it will be subjected during an automated assembly process for forming smoking articles. For example, it is important that the material has sufficient rollability, so that it can withstand a process in which the sheet material will be passed through a series of rollers. A sheet material having a tensile strength of less than 900 N/m is too brittle to be used in the conventional manufacturing processes for producing smoking articles and therefore unsuitable for use as an outer wrapper or tipping paper on a smoking article.

Preferably, the tensile strength of the sheet material is no more than 8000 N/m. More preferably, the tensile strength of the sheet material is less than 6000 N/m. This helps to ensure that the sheet material can be effectively rolled around a smoking article during manufacture. For example, the tensile strength of the sheet material is preferably between 900 N/m and 8000 N/m, more preferably between 1300 N/m and 6000 N/m.

The heat resistant sheet material used in the smoking articles of the present invention contains a significantly higher weight percentage of inorganic filler, or pigment, than conventional paper materials. This results in the material being more heat resistant than conventional cigarette paper, such that it can withstand the high temperatures to which the paper may be subjected during use of a smoking article, without significant loss of physical integrity. The sheet material used in smoking articles according to the present invention has been shown to exhibit significantly reduced levels of cracking and charring upon heating compared to conventional cigarette papers and in addition, shows a lesser degree of discolouration. Furthermore, the inorganic filler material advantageously does not release any undesired products or by-products upon heating and has a negligible effect on the heat transfer in the smoking article, or on the flavour of the volatile compounds delivered to the user.

Importantly, the sheet material used in the smoking articles of the present invention also provides surfaces that can readily be printed upon with good resolution and which can be glued, either to themselves or to other components of a smoking article. These properties are essential in providing a sheet material that is suitable for use in as an outer wrapper or tipping paper for a smoking article.

The heat resistant sheet material used in smoking articles of the present invention is based on a fibrous layer of a material that resembles a type of paper material but which has a higher level of inorganic filler than conventional paper materials. The fibrous layer for use in the sheet material of smoking articles of the present invention is formed from up to 50% of a suitable cellulosic pulp derived from wood, plant or certain grasses. Preferably, the fibrous layer is formed from up to 40% of such suitable pulp material. It is typically advantageous to maximise the average fibre length of the fibres in the cellulosic pulp to optimize the degree of refining or beating of the used pulp.

The inorganic filler material constitutes at least 50% by weight of the fibrous layer, more preferably at least 60% by weight, more preferably at least 70% by weight and most preferably at least 80% by weight. The inorganic filler material is a non-fibrous, particulate material comprising particles of substantially spherical shape. The inorganic filler material may comprise a single compound, or a mixture of compounds. Suitable filler compounds for forming the inorganic filler material include but are not limited to: calcium carbonate ($CaCO_3$), calcium sulphate ($CaSO_4$), an inorganic phase changing material, for example aluminium trihydroxide without crystal bound water ($Al(OH)_3.3H_2O$), aluminium (III) oxide ($Al_2O_3$) and mixtures thereof. The inorganic filler material has a particle size in the range of from about 0.1 microns to about 50 microns, preferably in the range of from about 0.1 microns to about 30 microns, more preferably in the range of from about 0.3 microns to about 3 microns.

It has been found that although an increase in the concentration of the inorganic filler material above 60% by weight results in a desirable improvement of the heat resistance of the sheet material, it can in certain circumstances reduce the tensile strength of the sheet material. Therefore in most cases it is preferable to include no more than 85 to 90% by weight of the inorganic filler, in order to optimise both the heat resistance and tensile strength properties of the sheet material of the invention.

Preferably, the fibrous layer further comprises a suitable binder material to improve the binding of the components of the layer. Advantageously, a suitable binder does not release pungent odour or toxicants due to decomposition when exposed to heat. Preferably, the binder material is an organic binder and may comprise a single organic binder compound, or a mixture of organic binder compounds. The presence of an organic binder material in the sheet material provides advantageous visco-elastic behaviour and improved machinability of the material.

Suitable organic binder compounds include but are not limited to: anionic starch, cationic starch, guar gum, xanthan gum, casein, polyvinyl alcohol and mixtures thereof. Preferably, the binder material comprises a naturally occurring organic binder, more preferably a cellulosic binder. In a particularly preferred embodiment, the binder material comprises a mixture of anionic starch and guar gum.

The amount of binder material can be selected depending upon the desired properties of the sheet material used in the smoking articles of the invention. Preferably, the binder material constitutes between about 0.1% and about 10% by weight of the fibrous layer, more preferably between about 0.5% and about 5% by weight. If desired, the fibrous layer may further comprise small percentage amounts of additional components. For example, certain constituents such as flocculants, coagulants or other processing aids may advantageously be incorporated in order to improve the processing of the raw materials for forming the fibrous sheet material. One example of a suitable flocculant is polyacrylamide, which is preferably incorporated at levels of less than 0.5% by weight and more preferably less than 0.1% by weight.

The fibrous layer preferably has a weight of between 70 and 130 grams per square meter (gsm) with a preferred weight of 80 grams per square meter (gsm).

Preferably, the sheet material used in smoking articles according to the present invention further comprises a coating layer on at least one side of the fibrous layer. More specifically, the sheet material may include an inner coating layer, an outer coating layer or both an inner coating layer and an outer coating layer. The coating layer or layers may partially or completely cover the fibrous layer. The term "inner coating layer" is used to refer to the coating layer that is on the inside surface of the sheet material when the sheet material is wrapped around a smoking article. The inner coating layer will therefore typically be in contact with the components of the smoking article being circumscribed by the sheet material.

Conversely, the term "outer coating layer" is used to refer to the coating layer that provides the outside surface of the sheet material when the sheet material is wrapped around a smoking article. It is therefore more important that the appearance of the outer coating layer is affected as little as possible by the heating.

Preferably, the coating layer or layers each comprise an inorganic filler material and a binder material. Preferably, the inorganic filler material constitutes at least 60% by weight of the coating layer, more preferably at least 70% by weight. The inorganic filler material may comprise a single inorganic filler compound, or a mixture of compounds. Suitable compounds for forming the inorganic filler material include but are not limited to calcium carbonate ($CaCO_3$), aluminium trihydroxide ($Al(OH)_3.3H_2O$), aluminium (III) oxide ($Al_2O_3$), titanium dioxide ($TiO_2$) and clays. Alternatively, the inner coating layer may comprise less or no inorganic filler material and instead be substantially composed of a binder. For example, the inner coating layer may be substantially composed of an impervious polymer, such as polyvinyl alcohol (PVOH) in order to prevent spotting.

Suitable and preferred binder materials are those identified above. These are organic binders which may comprise a single natural binder compound, or a mixture of natural binder compounds. Suitable organic binder compounds include but are not limited to: anionic starch, cationic starch, anionic starch, guar gum, xanthan gum, casein, polyvinyl alcohol and mixtures thereof.

Where both an inner coating layer and an outer coating layer are provided, the coating layers may have the same or different compositions, weights and thicknesses to each other.

Advantageously, the provision of an inner coating layer has been found to insulate the remainder of the sheet material from the heat generated by a heat source. This improves the resistance of the sheet material to the heat to which it is subjected during use of a smoking article according to the invention comprising the sheet material as outer wrapper or tipping paper. The provision of an outer coating layer has been found to reduce the discolouration and other visible changes of the outer sheet material upon heating.

Preferably, where a single coating layer is provided the weight of the coating layer is between 5 and 75 grains per square meter (gsm) and where both inner and outer coating layers are provided, the weight of each coating layer at least 10 grains per square meter (gsm), most preferably at least 20 grams per square meter (gsm). Preferably, the thickness of each coating layer is between 10 microns and 50 microns, more preferably between 20 and 30 microns.

Either the inner coating layer, or the outer coating layer, or both the inner coating layer and the outer coating layer may be formed of multiple layers, including, for example, one or more precoat layers and a topcoat layer on top of the precoat layer or layers. The topcoat layer preferably includes a mixture of inorganic filler material and binder material, as described above. The one or more precoat layers may be added to provide desirable properties to the outer coating layer, the inner coating layer or both. For example, a layer of an impervious polymer, such as polyvinyl alcohol (PVOH) may be provided in order to prevent the ingress of oxygen to the fibrous sheet material and reduce the likelihood of combustion of the sheet material upon heating.

In addition to the provision of coating layers, or as an alternative, the fibrous layer may be sprayed with a starch solution and this advantageously increases the tensile strength of the resultant sheet material. Where one or more coating layers are provided, the starch is sprayed onto the fibrous layer prior to the application of the coating layer or layers.

Preferably, the total thickness of the heat resistant sheet material is between 50 microns and 500 microns, more preferably between 70 microns and 200 microns, more preferably between 100 microns and 200 microns. Preferably, the weight of the sheet material is between 70 and 200 grams per square meter (gsm), more preferably between 100 and 200 gsm, more preferably between 120 and 160 gsm. Preferably, the sheet material is white in colour and remains white upon heating. This may be achieved through an appropriate selection of a white inorganic filler material or binder material in the coating layer or layers.

The heat resistant sheet material used in smoking articles according to the invention is formed by first mixing the fibrous cellulosic material, inorganic filler material and binder and additive materials, if present, and forming the mixture into a sheet material using conventional papermaking techniques. Optionally, the resultant sheet material may be sprayed with starch and then the inner coating layer and outer coating layer, where present, are deposited on the fibrous sheet material using any suitable deposition technique, such as spraying, dipping or curtain coating. The coating layers are dried under atmospheric conditions, without any requirement for further processing steps, such as pyrolysis or sintering.

The sheet material described above finds particular application as an outer wrapper for a heated smoking article according to the invention comprising a heat source and an aerosol-generating substrate, since the wrappers are sufficiently heat resistant to withstand the heat generated by the heat source of such smoking articles during use. In particular, outer wrappers formed of the sheet material described may advantageously be incorporated into distillation-based smoking articles of the construction described in WO-A-2009/022232 having a heat conducting element in contact with the heat source and the aerosol-generating substrate which, during use, transfers heat from the heat source to the substrate.

A preferred embodiment of the present invention provides a heated smoking article comprising a combustible heat source; an aerosol-generating substrate downstream of the combustible heat source; and an outer wrapper circumscribing at least a portion of the heat source and the aerosol-generating substrate, wherein the outer wrapper is formed of the heat resistant sheet material described above.

A variety of heated smoking articles comprising a combustible heat source are well known in the art and it would be apparent to the skilled person how to incorporate the outer wrapper described above into such smoking articles. A particularly suitable heated smoking article into which an outer wrapper of the heat resistant sheet material can be incorporated is the distillation-based heated smoking article described in WO-A-2009/022232.

Suitable combustible heat sources for use in heated smoking articles according to the invention, and methods for producing such heat sources, are well known in the art and described in, for example, U.S. Pat. No. 5,040,552, U.S. Pat. No. 5,060,676, U.S. Pat. No. 5,146,934, U.S. Pat. No. 5,188,130, U.S. Pat. No. 5,240,014, U.S. Pat. No. 5,246,018, U.S. Pat. No. 5,247,949, U.S. Pat. No. 5,443,560, U.S. Pat. No. 5,468,266 or U.S. Pat. No. 5,595,577.

Other preferred embodiments of the present invention provide an electrically heated aerosol generating system including an electrical heating element and an aerosol forming substrate, in particular such an electrically heated smoking systems using a continuous heating system. For example, such aerosol generating systems are disclosed in European Patent Application No. 09252687.0 corresponding to U.S. Patent Publication No. 2011/0126848 and in European Patent Application No. 09252501.3 corresponding to WO 2011/050964. The heat resistant sheet material described above may be used as outer wrapper for the aerosol forming substrate and optionally other suitable components invention or as a thermally stable carrier, for example a tubular carrier, for a solid aerosol-forming substrate.

The heat resistant sheet material described above also finds particular application as a tipping paper for a heated smoking article or a combustible smoking article according to the invention. The term "tipping paper" is a well known term which is typically used to refer to the paper that covers the filter and connects the filter to the rod of tobacco material, in particular in a conventional combustible smoking article. In the context of a heated smoking article, the tipping paper connects the mouthpiece to the abutting upstream component of the smoking article. Advantageously, the use of the heat resistant sheet material lowers the ignition propensity of the smoking article and in particular, the portion of the smoking article that is disposed of after smoking.

The sheet material 10 shown in FIG. 1 comprises a fibrous base layer 12, an inner coating layer 14 and an outer coating layer 16. The fibrous base layer is formed from the materials shown below in Table 1.

TABLE 1

| COMPOUND | FUNCTION | % w/w of the initial slurry |
|---|---|---|
| $Al(OH)_3 \cdot 3H_2O$ | Inorganic filler | 60 |
| Anionic starch | Binder | 0.4 |
| Guar gum | Binder | 0.3 |
| Cellulosic pulp | Fibrous base material | 39.3 |
| Polyacrylamide | Flocculant; processing aid | 0.03 |

Each of the inner coating layer 14 and the outer coating layer 16 is formed from the materials shown below in Table 2:

TABLE 2

| COMPOUND | FUNCTION | % w/w of the dried coating layer |
|---|---|---|
| $CaCO_3$ | Inorganic filler | 70 |
| Polyvinyl alcohol | Binder | 30 |

The thickness of each coating layer is 20 microns and each layer is 20 grams per square meter (gsm) in weight. The overall thickness of the outer wrapper is 140 microns and the overall weight is 140 grams per square meter (gsm).

Figure 2:
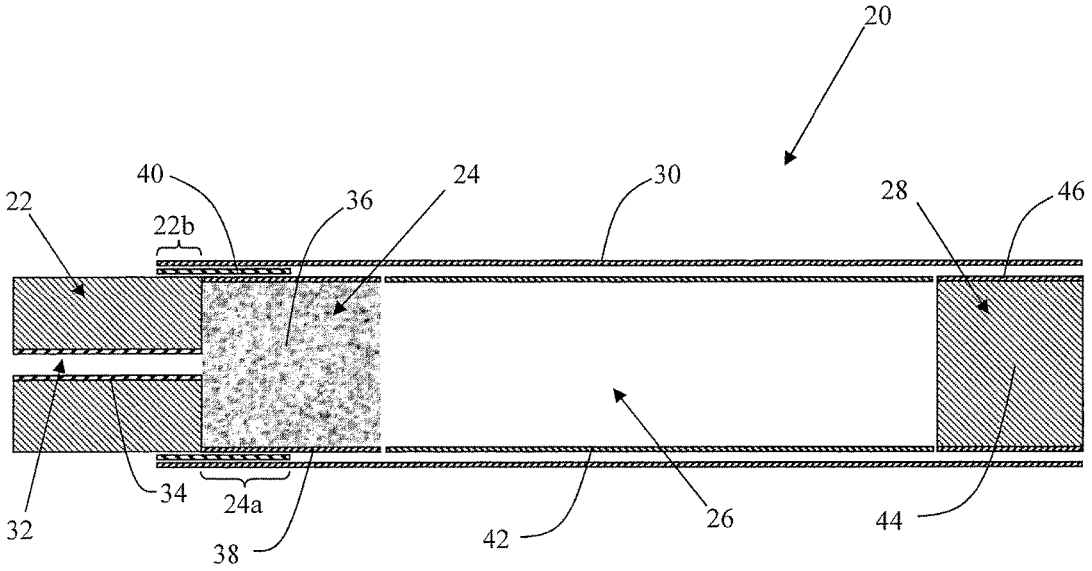
FIG. 2 shows a schematic, longitudinal cross-section of a heated smoking article according to the invention including an outer wrapper formed of the sheet material of FIG. 1.

The cigarette-like smoking article 20 according to the invention shown in FIG. 2 comprises a combustible heat source 22, an aerosol-generating substrate 24, an elongate expansion chamber 26 and a mouthpiece 28 in abutting coaxial alignment. All of the components are overwrapped in an outer wrapper 30 formed of the sheet material 10 shown in FIG. 1.

The combustible heat-source 22 is a pyrolised porous carbon-based heat source. The combustible heat source 22 is cylindrical and comprises a central airflow channel 32 that extends longitudinally through the combustible heat source 22. A substantially air impermeable, heat resistant coating 34 of iron oxide is provided on the inner surface of the central airflow channel 22.

The aerosol-generating substrate 24 is located immediately downstream of the combustible heat source 22 and comprises a cylindrical plug of homogenised tobacco material 36 comprising glycerine as aerosol former and circumscribed by filter plug wrap 38. The homogenised tobacco material 36 consists of longitudinally aligned filaments of extruded tobacco material.

A heat-conducting element 40 consisting of a tube of aluminium foil surrounds and is in contact with a rear portion **22*b* of the combustible heat source 22 and an abutting front portion 24*a* of the aerosol-generating substrate 24. As shown in FIG. 2, a rear portion of the aerosol-generating substrate 24 is not surrounded by the heat-conducting element 40**.

The elongate expansion chamber 26 is located downstream of the aerosol-generating substrate 24 and comprises a cylindrical open-ended tube of cardboard 42. The mouthpiece 28 of the smoking article 20 is located downstream of the expansion chamber 26 and comprises a cylindrical plug of cellulose acetate tow 44 of very low filtration efficiency circumscribed by filter plug wrap 46. The mouthpiece 28 may be circumscribed by tipping paper (not shown).

A smoking article having a similar construction is described in WO-A-2009/022232, which also describes how the components of the smoking article are produced and assembled.

The sheet material may be applied to a smoking article using known machinery and processes.

It will be appreciated that whilst in the smoking article described above, a number of components are provided in addition to the heat source and aerosol-generating substrate, the sheet material would also be suitable for any type of heated smoking article comprising a heat source and an aerosol-generating substrate.

We claim:

1. A smoking article including a heat resistant sheet material comprising:

a fibrous layer formed of cellulosic fibers and at least 50% by weight of an inorganic filler material having a particle size in the range of from about 0.1 microns to about 50 microns, wherein the sheet material has a tensile strength ranging from about 1300 N/m to about 6000 N/m and a thickness ranging from 70 microns to 200 microns, and wherein the fibrous layer further includes a binder material and the binder material constitutes about 0.5% to about 5% by weight of the fibrous layer, wherein the heat resistant sheet material is configured to withstand high temperatures to which the sheet material may be subjected during use without significant loss of physical integrity.

2. The smoking article of claim 1, wherein the heat resistant sheet material further comprises:

a coating layer at least partially covering one side of the fibrous layer.

3. The smoking article of claim 2, wherein the coating layer has a weight of about 5 grams per square meter (gsm) to about 75 gsm.

4. The smoking article of claim 2, wherein the coating layer comprises:

an inorganic filler material; and a binder material.

5. The smoking article of claim 4, wherein the binder material of the coating layer is selected from the group consisting of: anionic starch, cationic starch, guar gum, xanthan gum, casein, polyvinyl alcohol, and mixtures thereof.

6. The smoking article of claim 4, wherein the inorganic filler material of the coating layer is selected from the group consisting of: calcium carbonate ($CaCO_3$), aluminum trihydroxide ($Al(OH)_3$-$3H_2O$), aluminum (III) oxide ($Al_2O_3$), titanium dioxide ($TiO_2$), and clays.

7. The smoking article of claim 2, wherein the coating layer comprises:

a precoat layer including, polyvinyl alcohol (PVOH); and a topcoat layer disposed on top of the precoat layer, the topcoat layer including, an inorganic filler material, and a binder material.

8. The smoking article of claim 1, wherein the heat resistant sheet material further comprises:

an inner coating layer; and an outer coating layer, the fibrous layer between the inner coating layer and the outer coating layer.

9. The smoking article of claim 8, where in the inner coating layer and the outer coating layer have distinct compositions.

10. The smoking article of claim 8, wherein:

the inner coating layer has a thickness of about 10 microns to about 50 microns; and the outer coating layer has a thickness of about 10 microns to about 50 microns.

11. The smoking article of claim 10, wherein:

a weight of the inner coating layer is at least about 10 grams per square meter; and a weight of the outer coating layer is at least about 10 grams per square meter.

12. The smoking article of claim 8, wherein the thickness of the inner coating layer is distinct from the thickness of the outer coating layer.

13. The smoking article of 12, wherein the weight of the inner coating layer is distinct from the weight of the outer coating layer.

14. The smoking article of claim 1, wherein the inorganic filler material constitutes at least about 60% by weight of the fibrous layer.

15. The smoking article of claim 1, wherein the inorganic filler material constitutes at least about 70% by weight of the fibrous layer.

16. The smoking article of claim 1, wherein the inorganic filler material constitutes at least about 80% by weight of the fibrous layer.

17. The smoking article of claim 1, wherein the inorganic filler material constitutes about 85% to about 90% by weight of the fibrous layer.

18. The smoking article of claim 1, wherein the inorganic filler material has a particle size in a range of about 0.3 microns to about 30 microns.

19. The smoking article of claim 1, wherein the binder material is selected from the group consisting of: anionic starch, cationic starch, guar gum, xanthan gum, casein, polyvinyl alcohol, and mixtures thereof.

20. The smoking article of claim 1, wherein the fibrous layer further comprises:

polyacrylamide at less than about 0.5% by weight of the fibrous layer.

21. The smoking article of claim 20, wherein the polyacrylamide is present at less than about 0.1% by weight of the fibrous layer.

22. The smoking article of claim 1, wherein the inorganic filler material is selected from the group consisting of: calcium carbonate ($CaCO_3$), calcium sulphate ($CaSO_4$), aluminum trihydroxide without crystal bound water ($Al(OH)_3$-$3H_2O$), aluminum (III) oxide (Al2O3) and mixtures thereof.

* * * * *